United States Patent [19]

Bhatia

[11] Patent Number: 4,921,630

[45] **Date of Patent: * May 1, 1990**

[54] CONTACT LENS CLEANING COMPOSITIONS CONTAINING AN ENZYME AND A CARBOXY VINYL POLYMER

[75] Inventor: Rajkumar P. Bhatia, Arlington, Tex.

[73] Assignee: Alcon Laboratories, Inc., Fort Worth, Tex.

[ * ] Notice: The portion of the term of this patent subsequent to Jun. 13, 2006 has been disclaimed.

[21] Appl. No.: 229,767

[22] Filed: Aug. 4, 1988

Related U.S. Application Data

[63] Continuation of Ser. No. 945,998, Dec. 24, 1986, abandoned.

[51] Int. Cl.[5] ..... C11D 3/14

[52] U.S. Cl. ..... 252/174.12; 252/174.23; 252/174.24; 252/DIG. 2; 252/DIG. 12; 514/839; 514/840

[58] Field of Search ..... 252/174.12, 174.23, 252/174.24, DIG. 2, DIG. 12

[56] References Cited

U.S. PATENT DOCUMENTS

| | | | |
|---|---|---|---|
| 4,440,662 | 4/1984 | Tsuzuki et al. | 252/106 |
| 3,882,036 | 5/1975 | Krezanoski et al. | 252/106 |
| 3,910,296 | 10/1975 | Karageozian et al. | 134/2 |
| 3,954,644 | 5/1976 | Krezanoski et al. | 252/106 |
| 3,954,965 | 5/1976 | Boghosian et al. | 424/81 |
| 4,046,706 | 9/1977 | Krezanoski | 252/106 |
| 4,067,773 | 1/1978 | Martin | 195/63 |
| 4,096,870 | 6/1978 | Manfuso, Jr. | 134/28 |
| 4,127,423 | 11/1978 | Rankin | 134/30 |
| 4,357,173 | 11/1982 | Rosenthal et al. | 134/6 |
| 4,394,179 | 7/1983 | Ellis et al. | 134/7 |
| 4,421,665 | 12/1983 | Lloyd et al. | 252/106 |
| 4,493,783 | 1/1985 | Su et al. | 252/174.23 |
| 4,500,441 | 2/1985 | Tanaka et al. | 252/89.1 |
| 4,504,405 | 3/1985 | Howes | 252/106 |
| 4,521,254 | 6/1985 | Anderson et al. | 134/26 |
| 4,533,399 | 8/1985 | Mencke | 134/6 |
| 4,534,878 | 8/1985 | Ellis et al. | 252/173 |
| 4,588,444 | 5/1986 | Anderson | 134/2 |
| 4,599,195 | 7/1986 | Schafer et al. | 252/546 |
| 4,609,493 | 9/1986 | Schäfer | 252/546 |
| 4,655,957 | 4/1987 | Chromecek et al. | 252/174.23 |

*Primary Examiner*—John F. Niebling
*Assistant Examiner*—Isabelle Rodriquez
*Attorney, Agent, or Firm*—James A. Arno; Gregg C. Brown

[57] ABSTRACT

Contact lens cleaning compositions containing a combination of an enzyme and a carboxy vinyl polymer, and a method of cleaning contact lenses with such compositions are described. The compositions are capable of cleaning soiled contact lenses very rapidly and completely due to a favorable interaction between the enzyme component and an abrasive precipitate formed by the carboxy vinyl polymer component when a small amount of the compositions is rubbed on the lenses.

5 Claims, No Drawings

CONTACT LENS CLEANING COMPOSITIONS CONTAINING AN ENZYME AND A CARBOXY VINYL POLYMER

This is a continuation of application Ser. No. 945,998, filed Dec. 24, 1986, abandoned 9/21/88.

BACKGROUND OF THE INVENTION

1. Field of the Invention

The present invention relates to the field of contact lens care. More particularly, this invention relates to compositions for cleaning contact lenses which comprise an enzyme component and a carboxy vinyl polymer which forms an abrasive precipitate when the compositions are rubbed on contact lenses.

2. Discussion of Related Art

The cleaning of human-worn contact lenses is a problem which has been addressed in numerous prior art patents and other publications. Many of the previous attempts to solve this problem has focused on the use of particular types of surfactants; the following patents represent examples of such attempts: U.S. Pat. Nos. 3,882,036; 3,954,644; 4,046,706; and 4,599,195. The use of enzymes has also been proposed as a solution to this problem; U.S. Pat. Nos. 3,910,296; 3,954,965; 4,096,870; 4,521,254; and 4,609,493 describe this approach. A relatively recent approach addressing the cleaning problem utilizes polymeric particles as an abrasive material to physically remove deposits from the surface of the lens; this approach, which has been relatively successful, is described in U.S. Pat. No. 4,493,783. U.S. Pat. Nos. 4,394,179 and 4,534,878 describe approaches wherein inorganic abrasive materials are utilized. U.S. Pat. No. 4,533,399 describes the use of a fibrous web to clean contact lenses.

There have been numerous other attempts to solve the cleaning problem in addition to those cited above. The following U.S. patents may be referred to for additional background information in this regard: 4,127,423; 4,357,173; 4,421,665; 4,440,662; 4,500,441; and 4,504,405.

A new approach to the cleaning problem is described in the copending and commonly assigned application of Van Duzee titled "CONTACT LENS CLEANING PRODUCT AND METHOD OF USE." This approach is based on the use of a nonwoven web impregnated with an enzyme to clean contact lenses.

Another new approach is described in the copending and commonly assigned application of Bhatia, et al., titled "CONTACT LENS CLEANING COMPOSITION AND METHOD OF USE." This approach is based on the use of compositions comprising an enzyme and an abrasive particulate material to clean contact lenses.

SUMMARY OF THE INVENTION

A principal object of the present invention is the provision of compositions capable of rapidly and completely removing deposits of proteins, lipids, and other materials from contact lenses. A further object of this invention is the provision of a method of cleaning contact lenses using such compositions.

The foregoing objects and other general objectives of the present invention are achieved by the provision of contact lens cleaning compositions which comprise an enzyme to facilitate chemical decomposition and removal of deposits from contact lenses, particularly deposits of protein and lipid materials; a carboxy vinyl polymer which is dissolved in the composition, but forms an abrasive precipitate when rubbed on a contact lens, thereby facilitating physical removal of such deposits; and a suitable carrier for the enzyme and carboxy vinyl polymer. It has been discovered that such compositions are capable of removing deposits of proteins, lipids, and other materials from the surfaces of contact lenses in a very efficacious manner. The extent of cleaning achieved with these compositions is at least comparable with the cleaning achieved with cleaning compositions of the prior art, and in most cases is significantly better than the cleaning achieved with prior art compositions. The compositions of the present invention have been found to clean contact lenses much more rapidly than prior art compositions capable of providing a comparable extent of cleaning. The present compositions therefore represent a major advancement in the field of contact lens cleaning agents.

DESCRIPTION OF PREFERRED EMBODIMENTS

The contact lens cleaning compositions of the present invention contain an amount of one or more enzymes sufficient to substantially reduce deposits of proteins, lipids, and other materials on the lens being treated. The amount of enzyme contained in the compositions will vary depending on factors such as the particular type of enzyme utilized and the activity of that enzyme, the type of contact lens being treated, the cleaning regimen being employed (e.g., daily or weekly), and the concentration of other components in the compositions. The compositions of the present invention will typically contain from about 0.1% to about 50.0% by weight of one or more enzymes.

The enzymes which may be utilized in the present invention include all enzymes which are capable of removing deposits of proteins, lipids, and other materials from contact lenses safely and effectively. The "safely" requirement means that the enzymes must be relatively nontoxic to the eye at low concentrations, so that only mild ocular irritation will occur if a small amount of enzyme is inadvertently placed in the eye as the result of inadequate rinsing of a treated lens. The enzymes must also be capable of being easily removed from treated lenses by means of rinsing, and must not damage the contact lens being treated. Enzymes which meet the foregoing requirements are referred to herein as being "ophthalmically acceptable." Those skilled in the art will appreciate that the enzymes are also required to be chemically compatible with the other components of the present compositions.

The enzymes utilized in the present invention will most frequently be enzymes having proteolytic and/or lipolytic activity, since deposits of proteins and lipids are formed on most, if not all, human worn contact lenses. Examples of suitable proteolytic enzymes include pancreatin papain, Prolase RH (available from G. B. Fermentation Corp.), ficin, and bromelain. Examples of suitable lipolytic enzymes include Lipase K-3000 and Lipase AP6 (available from Amano Corp.), and pancreatic lipase. Those skilled in the art will readily appreciate that other proteolytic and lipolytic enzymes of plant, animal, bacterial, fungal or synthetic origin might also be employed in the present invention. Certain enzymes may require the presence of a stabilizing agent, such as acetylcysteine. Other methods of enzyme stabilization, such as bound enzyme systems and microencapsulated enzyme systems, may also be utilized. In a preferred embodiment of the present invention, enzyme stabilization is generally not a concern because the enzyme component of the lens cleaning compositions is packaged separately from the other components prior to use and is then combined with the other components at the time of initial use. This approach avoids the need for long-term enzyme stability in order to provide the compositions with a shelf-life of several months or more (i.e., roughly 18 months, generally), since the enzyme only needs to be stable for a relatively short time following combination of the enzyme and abrasive components (i.e., roughly 1 to 14 days, or in some cases slightly longer). This embodiment of the invention is described in greater detail below.

The compositions of the present invention contain an amount of a carboxy vinyl polymer sufficient to substantially reduce all deposits present on the surfaces of a contact lens by forming an abrasive precipitate when rubbed on the surface of the lens, thereby facilitating physical removal of such deposits. The precipitate formed by the carboxy vinyl polymer component of the present compositions is particularly effective in removing loosely bound deposits from the surfaces of a lens, such as deposits of debris (e.g., lint) and cosmetic residues, as well as large deposits of proteins, lipids, and other materials.

The carboxy vinyl polymers are contained in the present compositions in solubilized form. The mechanism by which these polymers form an abrasive precipitate when the compositions are rubbed on contact lenses is not completely understood at this time. It is believed that this precipitate is the result of water loss which occurs immediately when a few drops of the compositions are rubbed on a contact lens. This water loss results from a portion of the water in the compositions being taken up by the contact lens being treated, a portion of the water evaporating, and a generalized loss of the solubilizing effect of the water in the compositions as the compositions are spread out in a thin film when rubbed on contact lenses. This loss of water causes at least a portion of the carboxy vinyl polymer in the composition to come out of solution or "precipitate." The thus formed precipitate has been found to be very effective as an abrasive material in the cleaning of contact lenses, and may be used very advantageously for this purpose, because of the ease with which it can be removed from the lens after completion of cleaning by merely rinsing the lens to resolubilize the precipitated carboxy vinyl polymer.

The carboxy vinyl polymers which may be utilized in the present invention have a molecular weight of from about 1,000,000 to about 6,000,000. The polymers have carboxylic functional groups, and preferably contain 2 to 7 carbon atoms per functional group. These polymers include the carboxypolymethylene polymers available from the B. F. Goodrich Company under the name CARBOPOL.

The amount of carboxy vinyl polymer contained in the present compositions will vary depending on factors such as the particular type of carboxy vinyl polymer utilized, the type of contact lens being treated (e.g., "hard" or "soft") and the cleaning regimen being employed. The compositions of the present invention will typically contain from about 0.5% to about 25% by weight of one or more carboxy vinyl polymers.

The compositions of the present invention further comprise a carrier which is compatible with both ocular tissue and the other components of the compositions, including the carboxy vinyl polymer and enzyme components. Carriers which meet these requirements are referred to herein as being "ophthalmically acceptable." The carrier will typically be aqueous, and may include a thickening agent, such as various celluloses known for such use in the art (e.g., cellulose, hydroxyethylcellulose, and methoxy cellulose); polyethylene glycol with a molecular weight distribution of about 400 to about 4,000; low molecular weight hydroxyethylmethacrylate; polyvinyl alcohol; polyvinylpyrrolidone; polysaccharide gums (e.g., xanthan gum) and mixtures thereof.

The compositions may optionally further comprise one or more surfactants, preservatives, chelating agents, tonicity agents or antistatic agents. These types of ingredients are well known in the art. An exhaustive listing of illustrative examples of these ingredients is therefore believed to be both unnecessary and inappropriate. Representative examples of these types of ingredients include: surfactants such as polyoxyethylene/polyoxypropylene copolymers (e.g., PLURONIC 127); preservatives such as thimerosal, sorbic acid, POLYQUAD® (i.e., a polymeric germicide also known as ONAMER M, available from Onyx Chemical Co.), and benzalkonium chloride; chelating agents such as EDTA; tonicity agents such as sodium chloride and potassium chloride; and antistatic agents such as Foraperle B320 (available from Rilsan Corporation).

As mentioned above, a preferred embodiment of the present invention utilizes a packaging arrangement wherein the enzyme component of the compositions is not combined with the remaining components of the compositions until time of use. This arrangement avoids the necessity for long-term shelf-life stability. The compositions packaged in this manner are particularly preferred for professional use by an eye care specialist, such as an ophthalmologist, optometrist, optician or trained technician. A composition packaged in this manner can be conveniently prepared for use by merely combining the enzyme with the remaining components of the composition and mixing the combined components by means of agitation (i.e., shaking and/or stirring). The type of packaging utilized is not critical, so long as the packaging is suitable for phermaceutical use. The use of a sealed foil packet for the enzyme component and a sealed plastic bottle for the remaining components of the composition represents a preferred packaging arrangement. With this arrangement, the enzyme is simply removed from the packet, added to the container, and mixed with the contents of the container to provide a contact lens cleaning composition according to the present invention. Depending on the precise nature of the formulation, this composition would be useful for either a single, immediate use or many uses extending over several days.

The present invention also concerns a method of cleaning contact lenses utilizing the above-described compositions. This method comprises applying a small amount of the composition (e.g., a few drops if in liquid form) to the surfaces of the lens and rubbing the composition over the surfaces of the lens for a short time, normally for 30 seconds or less. The thus cleaned lens is then rinsed with a suitable contact lens rinsing solution (e.g., saline solution) to remove the cleaning composition and debris from the surface of the lens. As mentioned above, rinsing of the lens results in rehydration and consequent dissolution of the abrasive precipitate formed by the carboxy vinyl polymer. The dissolution of this precipitate helps to ensure that no abrasive material remains on lenses subsequent to cleaning with the present compositions; this represents a major advantage of the present invention. The lens will normally be completely cleaned at this point. Prior to reinsertion in the eye, the cleaned lens will normally be disinfected using various known disinfection methods, such as soaking in a disinfectant solution containing one or more germicides.

The mechanism which enables the compositions of the present invention to clean contact lenses completely and rapidly is not totally understood. However, it is clear that the remarkable results achieved with these compositions ae attributable to a positive interaction between the enzyme component of the present compositions and the abrasive precipitate formed by the carboxy vinyl polymer component of the compositions. Prior art compositions containing enzymes have generally been capable of completely cleaning lenses, but have typically required an extended soaking period of 15 minutes or more to achieve this cleaning. Prior art compositions containing an abrasive material have generally had the advantage of working very rapidly (i.e., in roughly one minute or less); however, the degree of cleaning achieved with these compositions has not been as complete as the cleaning achieved with enzyme-containing compositions. The prior art abrasive compositions have generally been very effective in removing large deposits from the surfaces of contact lenses, but have been less effective in removing minute deposits from the lens surface and have generally not been effective in removing deposits located beneath the surface of the lens in the pores or interstices of the lens. The compositions of the present invention have demonstrated a very surprising ability to clean soiled contact lenses both very rapidly and completely. The degree of cleaning achieved with the present compositions is much better than that achieved with prior art abrasive compositions, and the rapidity of cleaning is comparable or in some cases superior to that of prior art abrasive compositions.

EXAMPLE 1

This example further illustrates the formulation of compositions according to the present invention.

| Ingredient | Concentration (w/v %) Composition A | B | C |
|---|---|---|---|
| Pancreatin 6X | 1.0 | 2.0 | 5.0 |
| CARBOPOL EX140 | 2.0 | 2.0 | 2.0 |
| Boric Acid | 0.35 | 0.35 | 0.35 |
| Sodium Borate | 0.11 | 0.11 | 0.11 |
| Edetate Disodium | 0.1 | 0.1 | 0.1 |
| Sodium Chloride | 0.7 | 0.7 | 0.7 |

-continued

| Ingredient | Concentration (w/v %) Composition A | B | C |
|---|---|---|---|
| POLYQUAD ® | 0.001 + 10% Excess | 0.001 + 10% Excess | 0.001 + 10% Excess |
| HCl/NaOH | QS pH 5.5 | QS pH 5.5 | QS pH 5.5 |
| Purified Water | QS 1000 mL | QS 1000 mL | QS 1000 mL |

These compositions may be prepared as follows. Approximately 400 mL of the purified water is added to an aspirator bottle provided with appropriate attachments (e.g., 0.2 micron millipore filter, tubing, etc.). The CARBOPOL EX140 is then added to the purified water in the aspirator and mixed thoroughly. The set up is then steam sterilized at 121° C. under 15 lbs. pressure for 30 minutes, with continuous stirring until the solution has cooled. A second solution is then prepared by sequentially dissolving the sodium chloride, boric acid, edetate disodium, sodium borate, POLYQUAD ® and pancreatin in approximately 500 mL of the purified water, and adjusting the pH of the resulting solution to 5.5. The second solution is then filtered into the first solution using a 0.2 micron millipore filter assembly and mixed thoroughly. The final volume is then adjusted to 1000 mL with the remaining purified water.

What is claimed is:

1. A method of cleaning a contact lens which comprises:

applying to the lens a small amount of a composition comprising an ophthalmically acceptable enzyme in an amount sufficient to facilitate chemical decomposition and removal of deposits from the lens, an abrasive component consisting essentially of a carboxy vinyl polymer having a molecular weight of from about 1,000,000 to about 6,000,000 in an amount sufficient to facilitate physical removal of deposits and debris present on the lens by forming an abrasive precipitate when the composition is rubbed over the surface of the lens, and an ophthalmically acceptable carrier for the enzyme and the abrasive component;

rubbing the composition over the surface of the lens to form an abrasive precipitate of the carboxy vinyl polymer, said abrasive precipitate acting to physically remove deposits and debris present on the surface of the lens; and rinsing the lens to resolubilize the abrasive precipitate and remove the remaining composition and debris from the surface of the lens.

2. A method according to claim 1, wherein the enzyme is selected from proteolytic and lipolytic enzymes of plant, animal, bacterial, fungal or synthetic origin.

3. A method according to claim 1, wherein the enzyme comprises pancreatin.

4. A method according to claim 1, wherein the enzyme is contained in the composition in an amount of from about 0.1% to about 50.0% by weight.

5. A method according to claim 1, wherein the carboxy vinyl polymer is contained in the composition in an amount of from about 0.5% to about 25% by weight.

* * * * *